US005249975A

United States Patent [19]

Baderschneider et al.

[11] Patent Number: 5,249,975

[45] Date of Patent: Oct. 5, 1993

[54] STAMPED AND FORMED SEALED PIN

[75] Inventors: Kurt P. Baderschneider, Dreieich; Friedrich J. A. Kourimsky, Bensheim; Harald M. Lutsch, Dietzenbach, all of Fed. Rep. of Germany

[73] Assignee: The Whitaker Corporation, Wilmington, Del.

[21] Appl. No.: 984,131

[22] Filed: Dec. 1, 1992

[30] Foreign Application Priority Data

Dec. 20, 1991 [GB] United Kingdom ..... 9127052

[51] Int. Cl.[5] ..... H01R 13/00

[52] U.S. Cl. ..... 439/83; 439/876

[58] Field of Search ..... 439/80-84, 439/874-875

[56] References Cited

U.S. PATENT DOCUMENTS 3,268,851 8/1966 Mancini ..... 439/876

4,017,142 4/1977 Clark et al. ..... 439/876

4,266,838 5/1981 Segrott ..... 439/83

OTHER PUBLICATIONS

Mark Eyelet, Inc., Product Catalog pp. 57-58, 1987.

*Primary Examiner*—Joseph H. McGlynn

*Attorney, Agent, or Firm*—Eric J. Groen

[57] ABSTRACT

An electrical connector is disclosed having pin terminals positioned within an insulating housing where the terminal includes a cylindrical contact portion having an inner diameter formed at which carries a plastic cylindrical bead. The terminal also includes a serrated portion positioned within a converging bore portion of the housing passageway. A printed circuit board can be positioned against the lower portion of the housing and when wave soldered causes the serrated portion to form corresponding grooves in the housing through hole and causes the plastic bead to melt and fill the seam between the edges of the serrated portion.

7 Claims, 3 Drawing Sheets

STAMPED AND FORMED SEALED PIN

BACKGROUND OF THE INVENTION

1. Field of the Invention

The subject invention relates to a stamped and formed pin having a solid plastic material positioned within the formed pin, such that upon wave soldering the pins to a printed circuit board, the internal plastic plug liquifies to seal the seam forming the pin.

2. Descriotion of the Prior Art

Presently many pin headers which are wave soldered to print circuit boards include solid screw machined pins positioned within insulating housings. While these pins are in general an excellent electrical connection, the solid pin can, in the instance of the application of wave soldering the electrical connectors to printed circuit boards, detract from the quality of the electrical connection. First, as the electrical connectors are wave soldered to the board, the solid pins, typically a copper or brass alloy in composition, act as heat sinks for quickly removing the heat from a wave soldered connection, thereby cooling the solder joint too quickly, thereby forming an ineffective electrical connection, sometimes referred to as a "cold solder". Secondly, the heating of the solid pin can actually have an end result of loosening the terminal in the corresponding through hole of the tab header. In as much as the solid pins expand upon heating, as caused by the wave soldering, and subsequently contract after cooling, the expansion of the screw machined pins cause a compression of the electrical tab housing plastic around the pin causing an enlargement of the through hole, such that upon contraction of the pin upon cooling, the pin is actually loosened within its associated through hole.

Stamped and formed pins, while generally known for other types of electrical connections such as insulation displacement contacts and or crimp style contacts, this type of contact has not been readily used for electrical connections made with printed circuit boards particularly for use with wave soldering. In general, paints and/or fluxes are generally sprayed on the lower surface of the printed circuit board to prevent solder adhering to portions of the board upon wave soldering. Thus, the stamped and formed pins, having a central open area in the pin has heretofore provided a capillary formation, such that upon wave soldering, the paint, flux and/or solder tends to wick up through the formed capillary and possibly cause an ineffective electrical connection.

SUMMARY OF THE INVENTION

It is an object of the invention then to provide an electrical pin terminal for use with the application of wave soldering electrical headers to printed circuit boards.

It is a further object of the invention to provide an electrical connector which can be wave soldered to printed circuit boards where the pins are more firmly embedded in the corresponding insulative housing after the wave soldering process.

It is a further object of the invention to provide an electrical pin terminal design for use with wave soldering to printed circuit boards, where the pin terminal has an internal plastic plug which upon wave soldering will liquify to fill the seam formed by the stamped and formed pin.

The objects of the invention were accomplished by providing an electrical connector having at least one pin positioned in an insulating housing where the pin includes a mating contact portion extending from one side of said housing in a printed circuit board contact portion extending from another side thereof. The connector is characterized in that the pin is stamped and formed to include an elongate hollow cylindrical section forming said mating contact portion, and the hollow section has an elongate hollow seam formed by the forming of said cylindrical section. The hollow section comprises a cylindrical bead positioned within said cylindrical section having the ability to melt to fill said axial seam. In the preferred embodiment of the invention, the cylindrical bead is chosen from a plastic material which will melt during the wave soldering process of a printed circuit board to the electrical connector. In this manner, the electrical connector can be made from pins formed by a stamping and forming process rather than from solid pins, and the sealing of the pin takes place during the wave soldering process, rather than requiring a separate process.

In another aspect of the invention, an electrical connector has at least one pin positioned in an insulating housing where the pin includes a mating contact portion extending from one side of the housing and a printed circuit board contact portion extending from another side. The pin is stamped and formed to include an elongate cylindrical pin having a substantially closed seam forming said pin. The pin further comprises a retention section positioned medially between said elongate pin and said printed circuit contact portion, said retention section being formed by a plurality of serrated peripheral teeth forming upwardly facing retention surfaces. Said pin is positioned in a complementary through hole of a connector housing, where said serrated teeth are substantially encapsulated within said material forming said through hole. In the preferred embodiment of the invention the axial seam is wider at a lower portion thereof adjacent to the printed circuit board portion which allows said serrated portion to be radially contractible.

DETAILED DESCRIPTION OF THE PREFERRED EMBODIMENT

Figure 1:
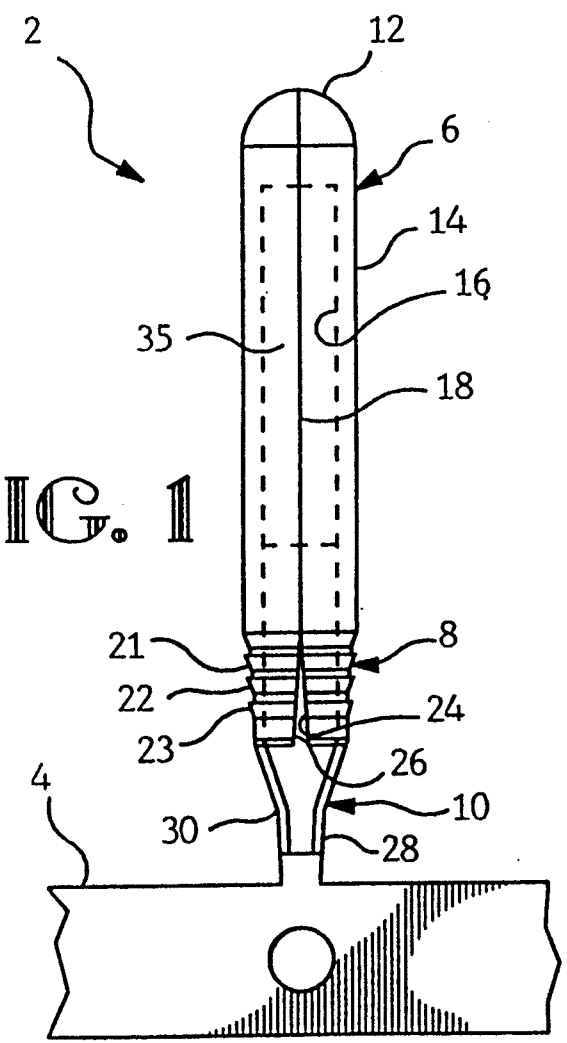
FIG. 1 is a front elevation view showing the stamped and formed terminal on the carrier strip.

With reference now to FIG. 1, a stamped and formed electrical pin is shown at 2 still interconnected to its corresponding carrier strip 4, the pin terminal including a pin mating section shown generally at 6, a serrated section shown at 8 and a printed circuit board contacting portion retention shown generally at 10. The terminal 2 is stamped and formed from a flat sheet of metal such as copper or brass alloy, and rolled into the configuration shown in FIG. 1. As formed, the terminal 2 includes a rounded tip section 12, and an elongated cylindrical contact section 14, the contact section 14 having an inner diameter shown at 16 and an elongate seam shown at 18. The serrated portion 8 is swaged to form frusto-conical sections such as 21, 22 and 23 each of which has an upwardly engaging edge, as will be described in greater detail herein. The section 8 includes two opposed edges 24 and 26 which are slightly spaced apart at a position adjacent to the printed circuit board contact 10 to allow the section 8 to be resiliently compressible into its associated connector housing. The printed circuit board contact 10 is comprised of two leg sections 28 and 30 formed in a substantial U-shape by way of a rear bight portion 32, shown best in FIG. 2.

Figure 2:
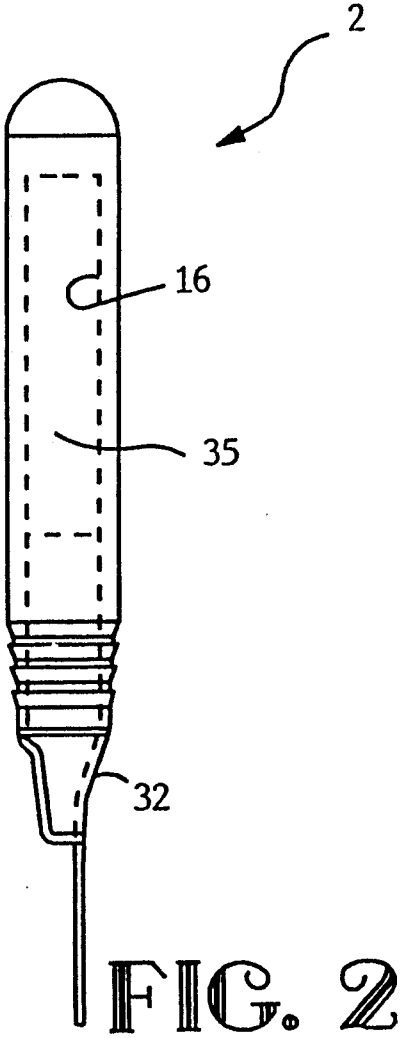
FIG. 2 is a side elevation view of the terminal shown in FIG. 1.

As shown in both FIGS. 1 and 2, the rolled pin section 6 further includes a cylindrical plastic bead 35 positioned within the inner diameter 16 of the pin portion 6, which in the preferred embodiment of the invention is an extruded plastic material which is both meltable and expandable. In the preferred embodiment of the invention, the bead 35 is a PBT material available under the trademark POCAN from Bayer as specification number KL17503. It should be appreciated that this is only one example, and that any kind of plastic material with these properties could be used.

Figure 3:
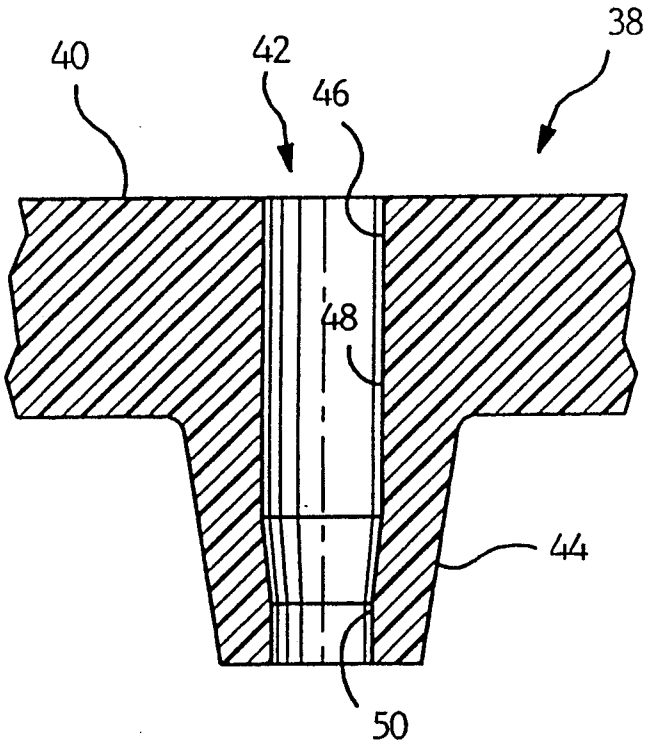
FIG. 3 is a cross sectional view of a through hole of a housing header in which the stamped and formed pin will reside.

As shown in FIG. 3, a portion of a pin housing is shown at 38 having an upper surface 40, a through hole for receiving the terminal 2 shown at 42 and a pillar portion shown at 44 for providing a stand off for a printed circuit board to which is mounted to the housing 38. As shown in FIG. 3, the through hole 42 includes a first cylindrical bore portion 46 contiguous with a converging bore portion 48, where the narrowed end of the converging bore 48 is continuous with a reduced diameter cylindrical bore portion 50. In the preferred embodiment of the invention, the housing 38 is formed of a plastic material comprised of a large group of glass fibre reinforced plastics, such as a PET plastic.

Figure 4:
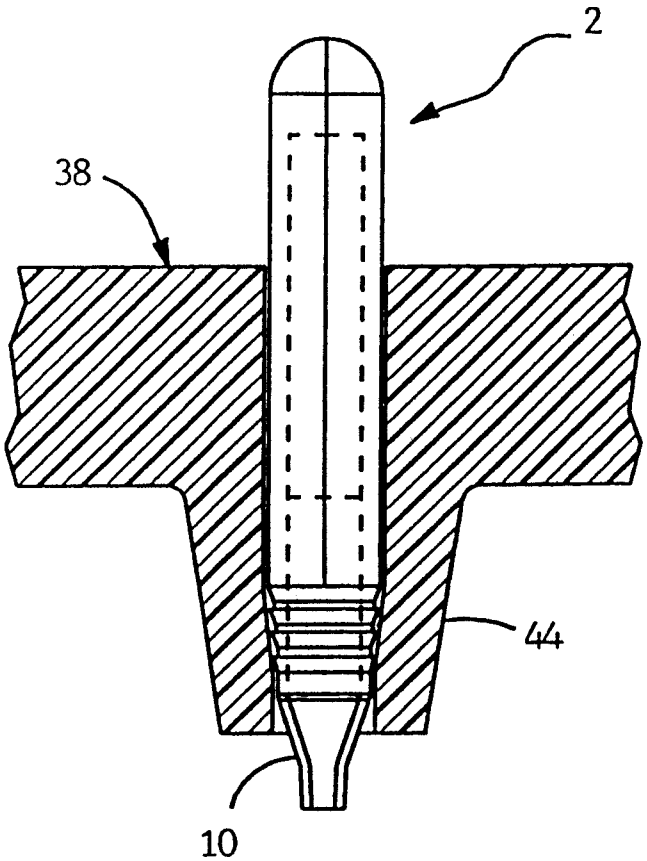
FIG. 4 is a cross sectional view showing the stamped and formed pin positioned in the header of FIG. 3.

To assemble a pin header comprised of pin terminals 2 and the pin housing 38, the pins are removed from the associated carrier strip 4 and inserted into corresponding through holes 42 such that the printed circuit board section 10 extends beyond the pillar portion 44 as shown in FIG. 4. It should be noted that as inserted in the through hole 42, as shown in FIG. 4, that the portion 8 is somewhat compressed within the converging bore 48 such the edges 24 and 26 are abutting each other. The pin terminals 2 are fixedly retained in place without further locking lances or the like such that the housing together with the terminals 2 can be moved about, as to a wave soldering line.

Figure 5:
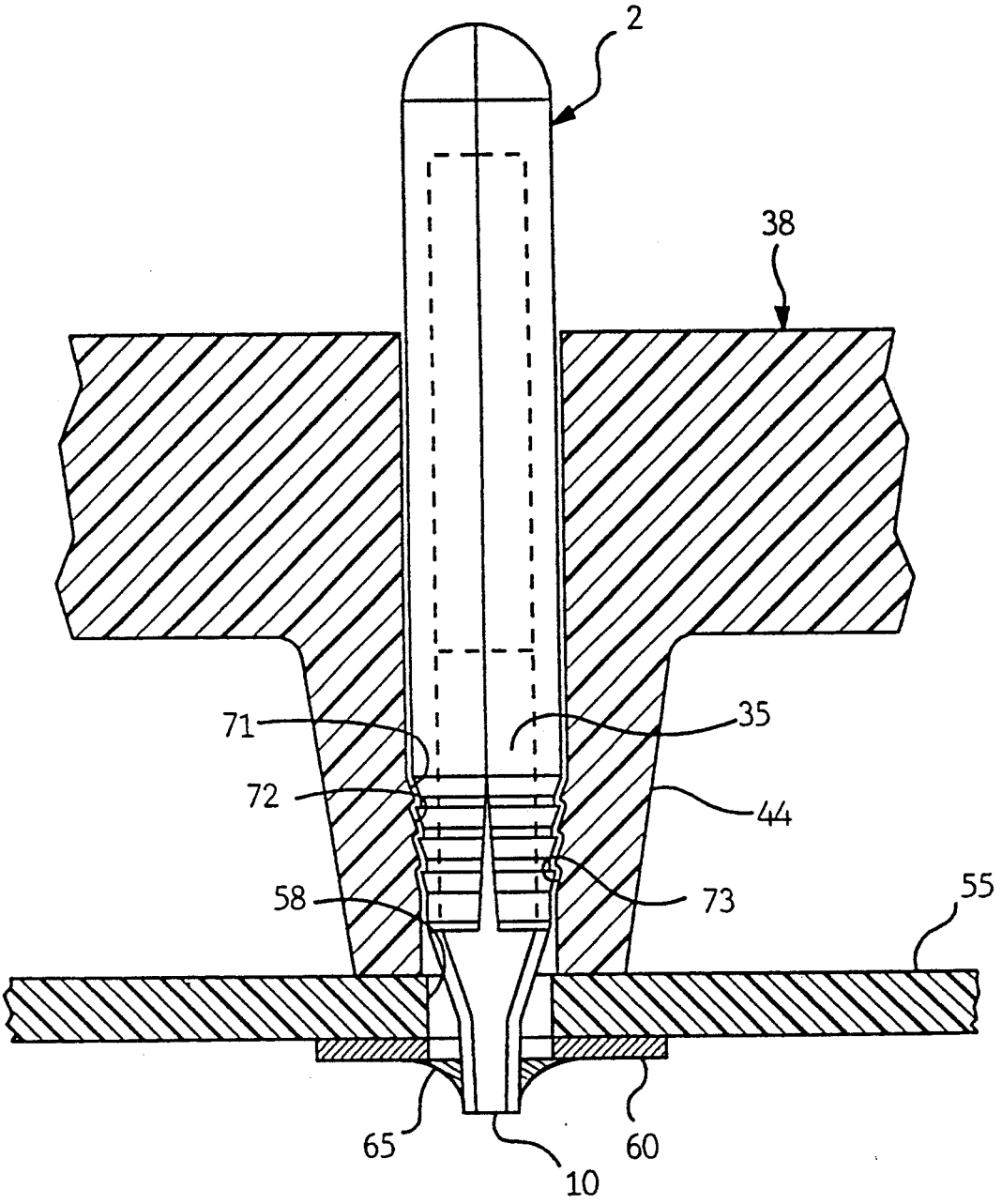
FIG. 5 is a cross-sectional view similar to that of FIG. 4 showing the terminal soldered to a printed circuit board.

As shown now in FIG. 5, a printed circuit board 55 can be positioned against the pillar portion 44 with a through hole 58 of the printed circuit board positioned over one of the printed circuit board portions 10. It should also be appreciated that the printed circuit board 55 includes a circuit trace 60 surrounding the through hole 58 as shown in FIG. 5. The assembly comprised of the pins 2, housings 38 and printed circuit board 55 can now be transferred to a wave soldering line where the printed circuit board portions 10 are electrically soldered to the circuit traces 60. As the connector assembly passes through the wave soldering line, the electrical terminals are soldered by way of a solder fillet for example at 65 in FIG. 5, thereby interconnecting the terminal portion 10 with the circuit trace 60. The heat from the wave soldering process radiates upwardly through the cylindrical pin portion but not at a thermodynamic rate to accelerate the forming of a cold solder connection. Rather, the heat is maintained within the lower portion of the pin terminal 2, having the effect of firmly fixing the terminal 2 in the housing 38 while at the same time sealing the open seam between the edges 24 and 26.

First, as mentioned above, the terminal portion 8 which is in the converging bore portion 48 is resiliently and incompressibly fixed in the bore portion, such that upon heating of the terminal portion 8, the combination of the heat of the wave soldering and the pressure caused by the outward radial resiliency causes an accelerated creep which forms grooves 71, 72 and 73 corresponding to frusto-conical portion 21, 22 and 23 (FIG. 1). The formation of the grooves 71–73 has the effect of not only locking the pin terminals 2 firmly within the housings 38 but also peripherally sealing the pin terminals 2 within the pillar portion 44 of the housing 38. In the preferred embodiment of the invention, the melting temperature of the housing is approximately 245° C.

It should be appreciated that a gap exists at the open seam between edges 24 and 26, which are not sealed within the converging bore portion 48, however the bead 35 is so chosen that the heat of the wave soldering causes the bead to liquify and expand thereby adhering to the inner diameter 16 within the pin portion 14. It should be appreciated that the bead 35 does not liquify to a position where the plastic flows freely, and into the terminal portion 10, but rather only liquifies to a position where it can expand and fill the inner diameter 16.

We claim:

1. An electrical connector having at least one pin positioned in an insulated housing, said pin including a mating contact portion extending from one side of said housing and a printed circuit board contact portion extending from another side thereof said connector being characterized in that:

said pin is stamped and formed to include an elongate hollow cylindrical section forming said mating contact portion, said hollow section having an elonqate seam formed by said forming, said hollow section further comprising a cylindrical bead positioned within said cylindrical section having the ability to melt to fill said axial seam.

2. The electrical connector of claim 1, characterized in that the cylindrical bead has a melting temperature sufficiently low, to melt and fill said axial seam during a wave soldering process, for connecting a printed circuit board to said printed circuit board portions.

3. The electrical connector according to claim 1, characterized in that said bead is formed of an extruded plastic material.

4. The electrical connector of claim 3, characterized in that the melting temperature of said cylindrical bead is between the range of 220° C. to 225° C.

5. An electrical connector having at least one pin positioned in an insulated housing, said pin including a mating contact portion extending from one side of said housing and a printed circuit board contact portion extending from another side thereof, said connector being characterized in that:

said pin is stamped and formed to include an elongate cylindrical pin having a substantially closed seam forming said pin, said pin further comprising a retention section positioned medially between said elongate pin and said printed circuit contact portion, said retention section being formed by a plurality of serrated peripheral teeth forming upwardly facing retention surfaces, said pin being positioned in a complementary through hole of a connector housing, said serrated teeth being substantially encapsulated with said material forming said through hole.

6. The electrical connector of claim 5, characterized in that said material around said through hole, has been melted to flow around said serrated teeth.

7. The electrical connector according to claim 5, characterized in that said serrated portion has an axial seam, wider at a lower portion thereof, adjacent to said printed circuit board portion, allowing said serrated portion to be radially contractible, to close said seam.

* * * * *